US012753467B2

(12) United States Patent
Yamanaka et al.

(10) Patent No.: US 12,753,467 B2
(45) Date of Patent: Oct. 6, 2026

(54) CEMENTED CARBIDE AND MOLD FOR ULTRA-HIGH PRESSURE GENERATING DEVICE USING THE SAME

(71) Applicant: Sumitomo Electric Hardmetal Corp., Itami (JP)

(72) Inventors: Syunsuke Yamanaka, Itami (JP); Eiji Yamamoto, Itami (JP); Kazuhiro Hirose, Itami (JP)

(73) Assignee: SUMITOMO ELECTRIC HARDMETAL CORP., Itami (JP)

( * ) Notice: Subject to any disclaimer, the term of this patent is extended or adjusted under 35 U.S.C. 154(b) by 875 days.

(21) Appl. No.: 17/922,004

(22) PCT Filed: Mar. 4, 2022

(86) PCT No.: PCT/JP2022/009484
§ 371 (c)(1),
(2) Date: Oct. 28, 2022

(87) PCT Pub. No.: WO2022/230364
PCT Pub. Date: Nov. 3, 2022

(65) Prior Publication Data

US 2024/0218488 A1 Jul. 4, 2024

(30) Foreign Application Priority Data

Apr. 28, 2021 (WO) ..... PCT/JP2021/016989

(51) Int. Cl.
*C22C 29/00* (2006.01)
*C22C 29/08* (2006.01)

(52) U.S. Cl.
CPC ..... *C22C 29/005* (2013.01); *C22C 29/08* (2013.01)

(58) Field of Classification Search
CPC ..... C22C 29/005; C22C 29/08; C22C 29/067; C22C 1/051
See application file for complete search history.

(56) References Cited

U.S. PATENT DOCUMENTS

| | | | |
|---|---|---|---|
| 2009/0044415 | A1 | 2/2009 | Fujino et al. |
| 2010/0098506 | A1 | 4/2010 | Tanaka et al. |

FOREIGN PATENT DOCUMENTS

| | | | |
|---|---|---|---|
| CN | 104451217 | A | 3/2015 |
| CN | 111378886 | A | 7/2020 |
| JP | 2001-181777 | A | 7/2001 |
| JP | 2008-38242 | A | 2/2008 |
| JP | 5289532 | B2 | 9/2013 |
| JP | 2015-81382 | A | 4/2015 |

(Continued)

*Primary Examiner* — Laura A Auer
(74) *Attorney, Agent, or Firm* — XSENSUS LLP

(57) ABSTRACT

A cemented carbide including a first phase being composed of a plurality of tungsten carbide grains and a second phase containing cobalt, wherein the cemented carbide contains chromium and vanadium, a mass-based percentage of the chromium to the cobalt is 5% or more and 9% or less, a mass-based percentage of the vanadium to the cobalt is 2% or more and 5% or less, an area ratio of the second phase is 7.5 area % or more and 13.5 area % or less, and a number of the second phases is 1000 or more, wherein the area ratio of the second phase and the number of the second phases are measured in a measurement field of 101 $\mu m^2$ by performing image processing on a scanning electron microscope image of a cross section of the cemented carbide.

18 Claims, 1 Drawing Sheet

(56) References Cited

FOREIGN PATENT DOCUMENTS

| | | | |
|---|---|---|---|
| JP | 2015-108162 | A | 6/2015 |
| JP | 2016-98421 | A | 5/2016 |
| WO | 2009/001929 | A1 | 12/2008 |

CEMENTED CARBIDE AND MOLD FOR ULTRA-HIGH PRESSURE GENERATING DEVICE USING THE SAME

CROSS-REFERENCE TO RELATED APPLICATIONS

The present application is based on PCT filing PCT/JP2022/009484, filed Mar. 4, 2022, which claims priority to PCT/JP2021/016989, filed Apr. 28, 2021, the entire contents of each are incorporated herein by reference.

TECHNICAL FIELD

The present disclosure relates to a cemented carbide and a mold for an ultra-high pressure generating device using the same.

BACKGROUND ART

Tungsten carbide-cobalt (WC—Co) cemented carbide, which has excellent mechanical properties, is used for molds for ultra-high pressure generating devices (for example, Patent Literatures 1 to 7).

CITATION LIST

Patent Literature

PTL 1: Japanese Patent Laying-Open No. 2001-181777
PTL 2: Japanese Patent Laying-Open No. 2008-38242
PTL 3: Japanese Patent Laying-Open No. 2015-108162
PTL 4: Japanese Patent Laying-Open No. 2016-098421
PTL 5: WO2009/001929
PTL 6: Japanese Patent Laying-Open No. 2015-081382
PTL 7: Chinese Patent Application Publication No. 111378886

SUMMARY OF INVENTION

A cemented carbide of the present disclosure is a cemented carbide comprising a first phase being composed of a plurality of tungsten carbide grains and a second phase containing cobalt, wherein the cemented carbide contains chromium and vanadium, a mass-based percentage of the chromium to the cobalt is 5% or more and 9% or less, a mass-based percentage of the vanadium to the cobalt is 2% or more and 5% or less, an area ratio of the second phase is 7.5 area % or more and 13.5 area % or less, and a number of the second phases is 1000 or more, wherein the area ratio of the second phase and the number of the second phases are measured in a measurement field of 101 $\mu m^2$ by performing image processing on a scanning electron microscope image of a cross section of the cemented carbide.

A mold for an ultra-high pressure generating device of the present disclosure is a mold for an ultra-high pressure generating device being composed of the cemented carbide described above.

DETAILED DESCRIPTION

Figure 1:
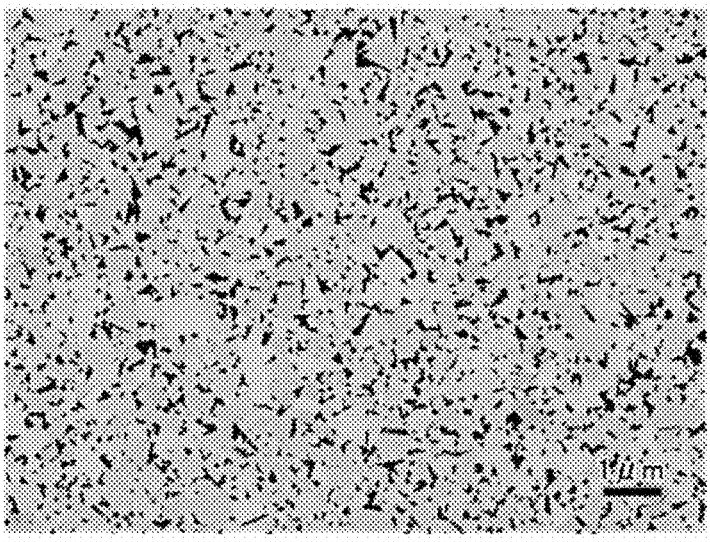
FIG. 1 is an example of a scanning electron microscope image of a cemented carbide according to Embodiment 1.

Problem to be Solved by the Present Disclosure

When an ultra-high pressure generating device is used, a very high pressure of up to about 20 GPa is applied to a mold for the ultra-high pressure generating device. Under such an ultra-high pressure, breakage is likely to occur and the tool lifespan tends to decrease. Therefore, there is a demand for a mold for an ultra-high pressure generating device that has a long tool lifespan even when used under ultra-high pressure.

Advantageous Effect of the Present Disclosure

According to a cemented carbide of the present disclosure, it is possible to obtain a mold for an ultra-high pressure generating device that has a long tool lifespan even under ultra-high pressure.

DESCRIPTION OF EMBODIMENTS

First, embodiments of the present disclosure will be listed and described.

(1) A cemented carbide of the present disclosure is a cemented carbide comprising a first phase being composed of a plurality of tungsten carbide grains and a second phase containing cobalt, wherein the cemented carbide contains chromium and vanadium, a mass-based percentage of the chromium to the cobalt is 5% or more and 9% or less, a mass-based percentage of the vanadium to the cobalt is 2% or more and 5% or less, an area ratio of the second phase is 7.5 area % or more and 13.5 area % or less, and a number of the second phases is 1000 or more, wherein the area ratio of the second phase and the number of the second phases are measured in a measurement field of 101 $\mu m^2$ by performing image processing on a scanning electron microscope image of a cross section of the cemented carbide.

According to a cemented carbide of the present disclosure, it is possible to obtain a mold for an ultra-high pressure generating device that has a long tool lifespan even under ultra-high pressure.

(2) The area ratio of the second phase is preferably 7.5 area % or more and 11.5 area % or less. According to this, it is possible to obtain an optimum balance between hardness and bending strength in the use of a mold for an ultra-high pressure generating device.

(3) The cobalt content of the cemented carbide is preferably 4 mass % or more and 8 mass % or less. According to this, it is possible to obtain an optimum balance between hardness and bending strength in the use of a mold for an ultra-high pressure generating device.

(4) The mass-based percentage of the chromium to the cobalt is preferably 7% or more and 8% or less. According to this, the cemented carbide can obtain stable bending strength and maintain a fine structure regardless of the carbon content.

(5) The mass-based percentage of the vanadium to the cobalt is preferably 2% or more and 4% or less. According to this, the cemented carbide can obtain stable bending strength and maintain a fine structure regardless of the carbon content.

(6) The number of the second phases is preferably 1000 or more and 1100 or less. According to this, the cemented carbide can obtain a fine structure and a high Vickers hardness.

(7) The tungsten carbide grains preferably have an average grain size of 0.05 μm or more and 0.3 μm or less. According to this, the hardness of the cemented carbide is improved.

(8) The area ratio of the first phase is preferably 86.5 area % or more and 92.5 area % or less. According to this, the hardness and abrasion resistance of the cemented carbide are improved.

(9) The cemented carbide preferably consists of the first phase and the second phase. According to this, the bending strength of the cemented carbide is improved.

(10) A mold for an ultra-high pressure generating device of the present disclosure is a mold for an ultra-high pressure generating device being composed of the cemented carbide described above. The mold for an ultra-high pressure generating device of the present disclosure can have a long tool lifespan even under ultra-high pressure.

DESCRIPTION OF EMBODIMENTS

Specific examples of the cemented carbide of the present disclosure and the mold for an ultra-high pressure generating device using the same will be described below with reference to the drawings. The same reference numerals indicate the same or equivalent portions in the figures of the present disclosure. Relation of such a dimension as a length, a width, a thickness, or a depth is modified as appropriate for clarity and brevity of the drawings and does not necessarily represent actual dimensional relation.

In the present disclosure, the expression "A to B" represents a range of lower to upper limits (i.e., A or more and B or less), and in a case where no unit is indicated for A and a unit is indicated only for B, the unit of A is the same as the unit of B.

In a case where a compound or the like is expressed by a chemical formula in the present disclosure and an atomic ratio is not particularly limited, it is assumed that all the conventionally known atomic ratios are included, and the atomic ratio is not necessarily limited only to one in the stoichiometric range. For example, in a case where "WC" is described, the atomic ratio in the WC is not limited to W:C=1:1 and includes all the conventionally known atomic ratios. The same also applies to compounds other than the "WC".

In the present disclosure, in a case where one or more numerical values are provided as a lower limit and an upper limit of a numerical range, it is considered that a combination of any one of the numerical values provided in the lower limit and any one of the numerical values provided in the upper limit is also disclosed. For example, in a case where a1 or more, b1 or more, and c1 or more are described as lower limits, and a2 or less, b2 or less, and c2 or less are described as upper limits, it is considered that a1 or more and a2 or less, a1 or more and b2 or less, a1 or more and c2 or less, b1 or more and a2 or less, b1 or more and b2 or less, b1 or more and c2 or less, c1 or more and a2 or less, c1 or more and b2 or less, and c1 or more and c2 or less are disclosed.

Embodiment 1: Cemented Carbide

A cemented carbide according to one embodiment of the present disclosure (hereinafter also referred to as "the present embodiment") is a cemented carbide comprising a first phase being composed of a plurality of tungsten carbide grains and a second phase containing cobalt, wherein the cemented carbide contains chromium and vanadium, a mass-based percentage of the chromium to the cobalt is 5% or more and 9% or less, a mass-based percentage of the vanadium to the cobalt is 2% or more and 5% or less, an area ratio of the second phase is 7.5 area % or more and 13.5 area % or less, and a number of the second phases is 1000 or more, wherein the area ratio of the second phase and the number of the second phases are measured in a measurement field of 101 $\mu m^2$ by performing image processing on a scanning electron microscope image of a cross section of the cemented carbide.

<Composition>

The cemented carbide of the present embodiment comprises a first phase being composed of a plurality of tungsten carbide grains, a second phase containing cobalt, and further contains chromium and vanadium.

<<Composition of First Phase>>

In the cemented carbide of the present embodiment, the first phase is composed of a plurality of tungsten carbide grains (hereinafter also referred to as "WC grains"). In the cemented carbide of the present embodiment, the first phase is a hard phase. The first phase may contain unavoidable impurity elements and the like in addition to the WC grains. As long as achieving the effects of the present disclosure, the content of WC grains in the first phase is preferably 99 mass % or more, more preferably 99.9 mass % or more, and more preferably substantially 100 mass %.

In addition to the tungsten carbide grains, the first phase may contain unavoidable impurity elements and a trace amount of impurity elements that are mixed in the manufacturing process of the WC grains, or the like, as long as the effects of the present disclosure are exhibited. Examples of these impurity elements include molybdenum (Mo) and chromium (Cr). The content of impurity elements in the first phase (the total content in a case where there are two or more impurity elements) is preferably 1 mass % or less, 0.1 mass % or less, or less than 0.1 mass %. The content of the impurity element in the first phase is measured by inductively coupled plasma (ICP) emission spectrometry (measurement device: "ICPS-8100" ™ manufactured by Shimadzu Corporation).

<<Area Ratio of First Phase>>

In the cemented carbide of the present embodiment, the area ratio of the first phase is preferably 86.5 area % or more and 92.5 area % or less. The area ratio of the first phase is measured in a measurement field of 101 $\mu m^2$ by performing image processing on a scanning electron microscope image of a cross section of the cemented carbide. According to this, the cemented carbide can have high hardness and excellent abrasion resistance. From the viewpoint of improving the hardness and abrasion resistance of the cemented carbide, the lower limit of the area ratio of the first phase is preferably 86.5 area % or more, 87.0 area % or more, or 88.5 area % or more. From the viewpoint of improving the toughness of the cemented carbide, the upper limit of the area ratio of the first phase is preferably 92.5 area % or less. The area ratio of the first phase is preferably 86.5 area % or more and 92.5 area % or less, 87.0 area % or more and 92.5 area % or less, or 88.5 area % or more and 92.5 area % or less. The details of the method for measuring the area ratio of the first phase will be described later.

<<Average Grain Size of Plurality of Tungsten Carbide Grains that Constitutes First Phase>>

In the cemented carbide of the present embodiment, since the area ratio of the second phase is 7.5 area % or more and 13.5 area % or less and the number of the second phases is 1000 or more, a plurality of WC grains that constitutes the second phase is fine, and the plurality of WC grains is dispersed in the second phase. The average grain size of the plurality of WC grains may be, for example, 0.05 μm or more and 0.3 μm or less. However, as long as the effect of the present disclosure is achieved, the cemented carbide of the present embodiment may contain a trace amount (for example, 20 or less per 1 $mm^2$ cross section of cemented carbide) of coarse WC grains (for example, grain size of 2 μm or more and 5 μm or less).

The lower limit of the average grain size of the WC grains is preferably 0.05 μm or more, 0.06 μm or more, or 0.08 μm or more. The upper limit of the average grain size of the WC grains is preferably 0.3 μm or less, 0.27 μm or less, or 0.23 μm or less. The average grain size of the WC grains is preferably 0.05 μm or more and 0.3 μm or less, 0.06 μm or more and 0.27 μm or less, and 0.08 μm or more and 0.23 μm or less.

The average grain size of the WC grains is measured by the following procedure. The cemented carbide is subjected to a cross section polisher (CP) process using an argon ion beam or the like, thereby obtaining a sample having a smooth cross section. The cross section of this sample is imaged at 5000 times using a field emission scanning electron microscope (FE-SEM, trade name: "JSM-7800F" manufactured by JEOL), to obtain a scanning electron microscope image (SEM-BSE image) of the cross section of the sample. The imaging conditions are an imaging magnification of 5000 times, an acceleration voltage of 5 kV, and a work distance of 10.0 mm.

A measurement field of 1 $mm^2$ (1 mm×1 mm rectangle) is set in the scanning electron microscope image. The outer edge of each WC grain in the measurement field is specified by using image analysis software (ImageJ ver. 1.51j8 (https://imagej.nih.gov/ij/)), and the circular equivalent diameter of each WC grain is calculated. A number-based arithmetic mean size of circular equivalent diameter of all WC grains in the measurement field is calculated.

The arithmetic mean size is measured at five different measurement fields without overlapping portions. The average value of the arithmetic mean sizes of the WC grains in the five measurement fields is calculated. This average value corresponds to the average grain size of the WC grains in the present embodiment.

As far as the applicant has measured, it has been confirmed that, as long as measurement is performed on the same sample, even if these measurements are performed a plurality of times by changing the selected portion of the measurement field, there is little variation in the measurement results, and even if the measurement field is arbitrarily set, the measurement does not become arbitrary.

<<Composition of Second Phase>>

In the cemented carbide of the present embodiment, the second phase contains cobalt (Co). In the cemented carbide of the present embodiment, the second phase is a binder phase. In addition to cobalt, the second phase may contain chromium (Cr), vanadium (V), unavoidable impurity elements, and the like. Examples of unavoidable impurity elements include iron (Fe), nickel (Ni), manganese (Mn), magnesium (Mg), calcium (Ca), molybdenum (Mo), sulfur (S), titanium (Ti), and aluminum (Al). The cobalt content of the second phase is preferably 85 mass % or more and 100 mass % or less. The content of elements other than cobalt in the second phase (the total content in a case where there are two or more kinds of these elements) is preferably 0 mass % or more and less than 1 mass %. The content of elements other than cobalt in the second phase is measured by inductively coupled plasma (ICP) emission spectrometry (measurement device: "ICPS-8100" ™ manufactured by Shimadzu Corporation).

<<Area Ratio and Number of Second Phase>>

In the cemented carbide of the present embodiment, the area ratio of the second phase is 7.5 area % or more and 13.5 area % or less, and the number of second phases is 1000 or more. The area ratio of the second phase and the number of second phases are measured in a measurement field of 101 $\mu m^2$ by performing image processing on a scanning electron microscope image of a cross section of the cemented carbide.

When the area ratio of the second phase is 7.5 area % or more and 13.5 area % or less, the cemented carbide can have excellent toughness. From the viewpoint of improving the toughness of the cemented carbide, the lower limit of the area ratio of the second phase is preferably 7.5 area % or more. From the viewpoint of improving the hardness and abrasion resistance of the cemented carbide, the upper limit of the area ratio of the second phase is preferably 13.5 area % or less, 13.0 area % or less, 11.5 area % or less, or 11.5 area % or less. The area ratio of the second phase is preferably 7.5 area % or more and 13.5 area % or less, 7.5 area % or more and 13.0 area % or less, or 7.5 area % or more and 11.5 area % or less.

When the area ratio of the second phase is 7.5 area % or more and 13.5 area % or less and the number of the second phases is 1000 or more, the cemented carbide is less likely to be broken even under ultra-high pressure. The reason for this is unclear, but it is considered that since fine WC grains (first phase) are dispersed in the second phase in the cemented carbide, the strength of the second phase is improved, and the hardness, bending strength, and high-temperature strength of the cemented carbide are improved.

In the cemented carbide of the present embodiment, the area ratio of the second phase is 7.5 area % or more and 13.5 area % or less, and the number of second phases is 1000 or more. From the viewpoint of the cobalt content and the fineness of the structure, the lower limit of the number of the second phase is preferably 1000 or more, 1010 or more, 1020 or more, 1030 or more, or 1040 or more. From the viewpoint of improving the bending strength and fracture toughness, the upper limit of the number of the second phase is preferably 1200 or less, 1150 or less, or 1100 or less. From the viewpoint of improving the hardness and improving the bending strength and fracture toughness, the number of the second phases is preferably 1,000 or more and 1200 or less, 1010 or more and 1200 or less, 1020 or more and 1150 or less, 1030 or more and 1150 or less, or 1040 or more and 1100 or less.

In the cemented carbide of the present embodiment, in a case where the area ratio of the second phase is 8 area % or more and 12 area % or less, or, 9 area % or more and 11 area % or less, the number of the second phase is preferably 1000 or more and 1200 or less, 1010 or more and 1200 or less, 1020 or more and 1150 or less, 1030 or more and 1150 or less, or 1040 or more and 1100 or less, from the viewpoint of improving the hardness and improving the bending strength and fracture toughness.

<<Method for Measuring Area Ratio of First Phase and Second Phase and Number of Second Phase>>

In the present specification, the method for measuring the area ratio of the first phase and the second phase and the number of the second phases is as follows.

The cemented carbide is subjected to a cross section polisher (CP) process using an argon ion beam or the like, thereby obtaining a sample having a smooth cross section. The cross section of this sample is imaged at 10000 times using a field emission scanning electron microscope (FE-SEM, trade name: "JSM-7800F" manufactured by JEOL), to obtain a scanning electron microscope image (SEM-BSE image) of the cross section of the sample. The imaging conditions are an imaging magnification of 10000 times, an acceleration voltage of 5 kV, and a work distance of 10.0 mm, and imaging is performed as a backscattered electron image. An example of a scanning electron microscope image of the cemented carbide according to the present embodiment is shown in FIG. 1. In FIG. 1, regions in gray correspond to the first phase, and regions in black correspond to the second phase.

A measurement field of 101 $\mu m^2$ (11.88 μm×8.5 μm rectangle) is set in the scanning electron microscope image.

Next, binarization processing is performed using image analysis software (ImageJ ver. 1.51j8 (https://imagej.nih.gov/ij/)). The binarization process is performed in the following procedures (a) to (d) in the initial setting state of the image analysis software.

(a) Edit→Invert (b) After above (a), Process→Binary→Make Binary (c) After above (b), Process→Noise→Despeckle The above operation (c) is repeated three times. Since the number of times of noise removal in (c) affects the number of second phases, the number of times of operation in (c) is fixed to three times in the present embodiment.

(d) After above (c), Process→Binary→Watershed

Figure 2:
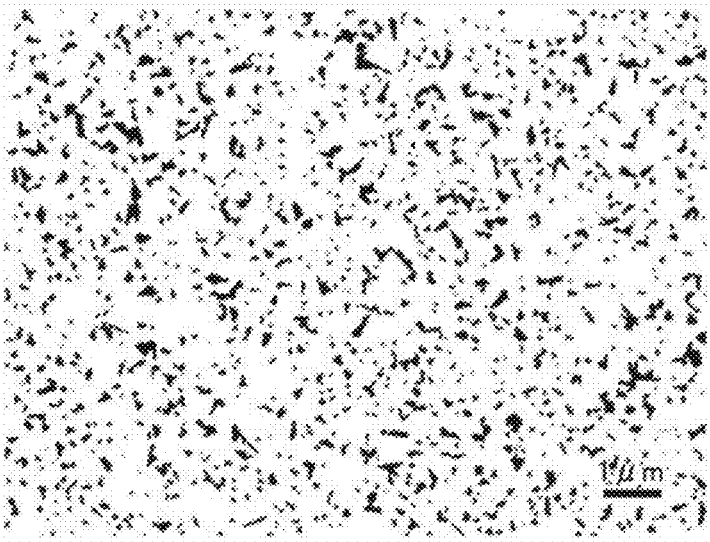
FIG. 2 is an image obtained by performing binarization process on FIG. 1.

FIG. 2 shows an image obtained by performing binarization process on the scanning electron microscope image shown in FIG. 1. In FIG. 2, regions in white correspond to the first phase, and portions in black correspond to the second phase.

The sum (total area) of the areas of all the first phases in the measurement field is calculated. The percentage of the total area of the first phase to the entire measurement field is calculated, taking the entire measurement field as 100 area %. This percentage corresponds to the area ratio of the first phase in the measurement field.

The sum (total area) of the areas of all the second phases in the measurement field is calculated. The percentage of the total area of the second phase to the entire measurement field is calculated, taking the entire measurement field as 100 area %. This percentage corresponds to the area ratio of the second phase in the measurement field.

Based on the binarization process, the number of second phases in the measurement field is measured. In a case where it is considered from the shape of the second phase that the second phase is formed by joining or contacting two or more second phases, the number of second phases having the shape is determined to be one.

In the scanning electron microscope image, five measurement fields are set so that there are no overlapping portions, and the area ratios of the first phase and second phase in the measurement field and the number of the second phases in the measurement field are obtained in each of the five fields. The average value of the area ratio of the first phase in the five measurement fields corresponds to the "area ratio of the first phase in the measurement field" in the present specification. The average value of the area ratio of the second phase in the five measurement fields corresponds to the "area ratio of the second phase in the measurement field" in the present specification. The average value of the number of the second phase in the five measurement fields corresponds to the "number of the second phase in the measurement field" in the present specification.

As far as the applicant has measured, it has been confirmed that, as long as measurement is performed on the same sample, even if these measurements are performed a plurality of times by changing the selected portion of the measurement field, there is little variation in the measurement results, and even if the measurement field is arbitrarily set, the measurement does not become arbitrary.

<<Cobalt Content>>

The cobalt content of the cemented carbide of the present embodiment is preferably 4 mass % or more and 8 mass % or less. According to this, the cemented carbide can have excellent toughness. From the viewpoint of improving toughness, the lower limit of the cobalt content of the cemented carbide is preferably 4 mass % or more, 4.5 mass % or more, or 5 mass % or more. From the viewpoint of improving abrasion resistance, the upper limit of the cobalt content of the cemented carbide is preferably 8 mass % or less, 7.5 mass % or less, or 7 mass % or less. From the viewpoint of improving toughness and abrasion resistance, the cobalt content of the cemented carbide is preferably 4 mass % or more and 8 mass % or less, 4.5 mass % or more and 7.5 mass % or less, or 5 mass % or more and 7 mass % or less. The cobalt content in the cemented carbide can be obtained by analysis by TAS0054:2017 cobalt potentiometric titration method for cemented carbide.

<<Chromium>>

In the cemented carbide of the present embodiment, the mass-based percentage of chromium to cobalt is 5% or more and 9% or less. Chromium has a grain growth inhibiting action on the tungsten carbide grains. Generally, chromium is added as a carbide of chromium such as $Cr_3C_2$ in the production process of cemented carbide.

When the percentage of chromium is within the above range, the grain growth inhibiting action is likely to be exerted. From the viewpoint of improving the grain growth inhibiting action, the lower limit of the mass-based percentage of chromium to cobalt is preferably 5% or more, 5.5% or more, 6% or more, 6.6% or more, or 7% or more. From the viewpoint of improving the bending strength and fracture toughness, the upper limit of the mass-based percentage of chromium to cobalt is preferably 9% or less, 8.5% or less, or 8% or less. From the viewpoint of improving the grain growth inhibiting action and improving the hardness, the mass-based percentage of chromium to cobalt is 5% or more and 9% or less, preferably 5.5% or more and 8.5% or less, 6% or more and 8% or less, 6.6% or more and 8% or less, or 7% or more and 8% or less. The mass-based percentage of chromium to cobalt in the cemented carbide of the present embodiment can be determined by analyzing the cobalt content and the chromium content of the cemented carbide by inductively coupled plasma (ICP) emission spectrometry.

In the cemented carbide of the present embodiment, the lower limit of the mass-based percentage of chromium is preferably 0.20% or more, 0.25% or more, or 0.30% or more. The mass-based content of chromium is preferably 0.72% or less, 0.65% or less, or 0.60% or less. The mass-based percentage of chromium is preferably 0.20% or more and 0.72% or less, 0.25% or more and 0.65% or less, or 0.30% or more and 0.60% or less. The mass-based percentage of chromium in the cemented carbide of the present embodiment can be measured by inductively coupled plasma (ICP) emission spectrometry.

<<Vanadium>>

In the cemented carbide of the present embodiment, the mass-based percentage of vanadium to cobalt is 2% or more and 5% or less. Vanadium has a grain growth inhibiting action on the tungsten carbide grains. Generally, vanadium is added as a carbide of vanadium such as VC in the production process of cemented carbide.

When the percentage of vanadium is within the above range, the grain growth inhibiting action is likely to be exerted. From the viewpoint of improving the grain growth inhibiting action, the lower limit of the mass-based percentage of vanadium to cobalt may be 2% or more, 2.1% or more, 2.2% or more, or 3% or more. From the viewpoint of improving the bending strength and fracture toughness, the upper limit of the mass-based percentage of vanadium to cobalt is preferably 5% or less, 4.5% or less, or 4% or less. From the viewpoint of improving the grain growth inhibiting action and improving the hardness, the mass-based percentage of vanadium to cobalt is 2% or more and 5% or less, preferably 2.1% or more and 5% or less, and 2.1% or more and 4.5% or less, 2.2% or more and 4% or less, or 3% or more and 4% or less. The mass-based percentage of vanadium to cobalt can be determined by analyzing the cobalt content and the vanadium content of the cemented carbide by inductively coupled plasma (ICP) emission spectrometry.

In the cemented carbide of the present embodiment, the lower limit of the mass-based percentage of vanadium is preferably 0.08% or more, 0.10% or more, or 0.12% or more. The mass-based content of vanadium is preferably 0.30% or less, 0.35% or less, or 0.40% or less. The mass-based percentage of vanadium is preferably 0.08% or more and 0.40% or less, 0.10% or more and 0.35% or less, or 0.12% or more and 0.30% or less. The mass-based percentage of vanadium in the cemented carbide of the present embodiment can be measured by inductively coupled plasma (ICP) emission spectrometry.

<<Third Phase>>

It is preferable that the cemented carbide of the present embodiment consists of the first phase and the second phase and does not substantially contain any other phase other than the first phase and the second phase (also referred to as "third phase" in the present specification). The cemented carbide of the present embodiment preferably consists of the first phase and the second phase. The cemented carbide of the present embodiment may contain unavoidable impurities in addition to the first phase and the second phase as long as the effect of the present disclosure is achieved.

An example of the third phase is one in which Cr or V contained in $Cr_3C_2$ or VC added as a grain growth inhibitor forms a different phase from the first phase and the second phase. In a conventional cemented carbide, $Cr_3C_2$ or VC added as a grain growth inhibitor forms a third phase separate from the first phase and the second phase. In a case where the third phase is present in the cemented carbide, it acts as a starting point of fracture to decrease the bending strength, and also serves as a starting point of fracture of the mold for an ultra-high pressure generating device or the like to decrease the lifespan. On the other hand, in a case where the third phase is not present in the cemented carbide, the third phase does not act as a starting point of fracture, so that the bending strength is improved, leading to an improvement in the lifespan of the mold for an ultra-high pressure generating device.

The present inventors have assumed that the grain growth inhibiting action is improved when Cr or V is present at the boundary between the first phase and the second phase or in the second phase rather than in the third phase, and as a result of careful examination, established a method for producing a cemented carbide substantially free of the third phase, and obtained the cemented carbide of the present embodiment. Here, "the third phase is not substantially present" does not exclude the presence of a trace amount of the third phase as long as the effects of the present disclosure are achieved.

Whether or not the third phase is present in the cemented carbide can be confirmed by analyzing the structure of the cemented carbide by wavelength dispersive X-ray analysis (WDX) using the field emission scanning electron microscope described above. Details of the WDX are described in reference document 1 (Hisashi Suzuki, Kei Tokumoto (1984), Microstructures and Mechanical Properties of WC—$Cr_3C_2$-15% Co Cemented Carbide, Powder and Powder Metallurgy, Vol. 31. No. 2, 56-59). In the case where the third phase is present in the cemented carbide, the enriched phases of Cr, V, and C are confirmed in the WDX analysis. In the cemented carbide of the present embodiment, the third phase is not substantially present, so that no enriched phases of Cr, V, and C are confirmed in the WDX analysis. In the cemented carbide of the present embodiment, the third phase is not substantially present so that the third phase does not act as a starting point of fracture, and thus the bending strength is improved, and the lifespan is improved in a case where the cemented carbide is used in a mold for an ultra-high pressure generating device or the like.

Other examples of the third phase include low carbon cobalt-tungsten carbides, known as the η phase, such as $Co_3W_3C$, $Co_6W_6C$, $Co_2W_4C$, and $Co_3W_9C_4$. The 1 phase is likely to be the starting point of fracture. Since the cemented carbide of the present embodiment does not contain the η phase, the bending strength is improved, and the lifespan is improved in a case where the cemented carbide is used in a mold for an ultra-high pressure generating device or the like.

Whether or not the η phase is present in the cemented carbide is confirmed by the following procedure. The surface of the cemented carbide is ground by a diamond wheel using diamond grains having an average grain size of 150 μm, and then polished by a predetermined thickness by a diamond paste having an average grain size of 1 μm. The polished surface is etched to observe the structure. In a case where the 7 phase is present in the cemented carbide, a structure in which the 1 phase is preferentially etched is confirmed.

<Vickers Hardness>

The Vickers hardness Hv30 of the cemented carbide of the present embodiment is preferably 1950 or more. According to this, the abrasion resistance of the cemented carbide is improved. From the viewpoint of improving the abrasion resistance, the lower limit of the Vickers hardness is preferably 1950 or more, 2000 or more, or 2030 or more. From the viewpoint of improving the abrasion resistance, the upper limit of the Vickers hardness is preferably 2500 or less, 2300 or less, or 2200 or less. The Vickers hardness is preferably 1950 or more and 2500 or less, 2000 or more and 2300 or less, or 2030 or more and 2200 or less.

The Vickers hardness is measured in accordance with JISZ2244:2009 Vickers hardness test. The measurement conditions are room temperature (23° C.±5° C.), test load of 294.2 N (30 kgf, Hv30), and holding time of 20 seconds.

<Bending Strength>

The bending strength of the cemented carbide of the present embodiment is preferably 2.8 GPa or more. According to this, the lifespan of the mold for an ultra-high pressure generating device is improved. From the viewpoint of improving the lifespan of the mold for an ultra-high pressure generating device, the lower limit of the bending strength is preferably 2.8 GPa or more, 3.0 GPa or more, or 3.2 GPa or more. The upper limit of the bending strength is not particularly limited, but may be 6.0 GPa or less from the viewpoint of production. From the viewpoint of improving the lifespan of the mold for an ultra-high pressure generating device, the bending strength of the cemented carbide is preferably 2.8 GPa or more and 6.0 GPa or less, 3.0 GPa or more and 6.0 GPa or less, or 3.2 GPa or more and 6.0 GPa or less.

The bending strength is measured in accordance with CIS026B-2007 Cemented Carbide Bending Strength Test Method. The test piece size is 4 mm×8 mm×25 mm, the load point/fulcrum size is R2.0 mm, and the fulcrum span is 20 mm. The measurement temperature is room temperature (23° C.±5° C.).

<Application>

The cemented carbide of the present embodiment can be suitably used for tools used under ultra-high pressure. Examples of such tools include molds for ultra-high pressure generating devices, drawing dies, extrusion dies, rolling rolls, canning tools, forging molds, and powder molds.

Embodiment 2: Method for Producing Cemented Carbide

The cemented carbide of the present embodiment can be manufactured, for example, by the following method. The cemented carbide of the present embodiment may also be produced by methods other than the following.

The cemented carbide of the present embodiment can be typically produced by performing a raw material powder preparation step, a mixing step, a molding step, a sintering step, and a cooling step in the order described above. Each step will be described below.

<<Preparation Step>>

The preparation step is a step of preparing all the raw material powders of the materials that constitute the cemented carbide. As the raw material powders, tungsten carbide powder as the raw material of the first phase, cobalt (Co) powder as the raw material of the second phase, and chromium carbide ($Cr_3C_2$) powder and vanadium carbide (VC) powder are prepared as the grain growth inhibitor. Commercially available tungsten carbide powder, cobalt powder, chromium carbide powder, and vanadium carbide powder can be used.

As the tungsten carbide powder, it is preferable to use tungsten carbide powder carbonized at a temperature of 1400° C. or more and 1600° C. or less. The grain size of the tungsten carbide powder is preferably about 0.1 to 0.3 μm. According to this, the stability of WC grains is enhanced at the stage of liquid phase appearance during sintering, so that dissolution and reprecipitation are suppressed, and a fine cemented carbide structure is obtained and coarse WC grains are hardly generated. As an effect of this, the amount of $Cr_3C_2$ or VC added for the purpose of inhibiting grain growth can be suppressed to a low level, and the precipitation of the third phase in the cemented carbide structure, which causes a decrease in strength, can be suppressed. The present inventors have newly found that the use of the above WC powder can suppress the precipitation of the third phase in the cemented carbide structure. In the present specification, unless otherwise specified, the average grain size of the raw material powder means an average grain size measured by Fisher Sub-Sieve Sizer (FSSS) method (measuring device: "Fisher Sub-Sieve Sizer Model 95" ™ manufactured by Fisher Scientific International, Inc.).

Conventionally, tungsten carbide powder carbonized at a temperature of 1100° C. or more and 1350° C. or less and pulverized to a grain size of 0.1 to 0.3 μm has been used as the tungsten carbide powder. In this case, since the tungsten carbide powder is fine, tungsten carbide is dissolved and reprecipitated in cobalt during sintering, and as a result, the grain size of the WC grains increases, and the hardness of the cemented carbide tends to decrease.

The average grain size of the cobalt powder may be 0.4 μm or more and 1.0 μm or less (FSSS method). The average grain size of the chromium carbide powder may be 0.5 μm or more and 3 μm or less (FSSS method). The average grain size of the vanadium carbide powder may be 0.5 μm or more and 3 μm or less (FSSS method).

<<Mixing Step>>

The mixing step is a step of mixing each raw material powder prepared in the preparation step. A mixed powder in which each raw material powder is mixed is obtained by the mixing step.

The content of the tungsten carbide powder in the mixed powder may be, for example, 90.88 mass % or more and 95.72 mass % or less.

The content of the cobalt powder in the mixed powder may be, for example, 4 mass % or more and 8 mass % or less.

The content of the chromium carbide powder in the mixed powder may be, for example, 0.2 mass % or more and 0.72 mass % or less.

The content of the vanadium carbide powder in the mixed powder may be, for example, 0.08 mass % or more and 0.4 mass % or less.

The mixed powder is mixed using a ball mill. The media diameter may be 1 mm to 10 mm. The rotation speed may be 10 to 120 rpm. Mixing time may be from 20 hours or more and 48 hours or less.

After the mixing step, the mixed powder may be granulated as necessary. By granulating the mixed powder, it is easy to fill the mixed powder into a die or mold during the molding step described below. A known granulation method can be applied for granulation, and for example, a commercially available granulator such as a spray dryer can be used.

<<Molding Step>>

The molding step is a step of molding the mixed powder obtained in the mixing step into a predetermined shape to obtain a molded body. The molding method and molding conditions in the molding step are not particularly limited as long as general methods and conditions may be employed. Examples of the predetermined shape include a shape of a mold for an ultra-high pressure generating device (for example, a shape of an anvil).

<<Sintering Step>>

The sintering step is a step of sintering the molded body obtained in the molding step to obtain a cemented carbide. In the method for producing cemented carbide of the present embodiment, the sintering temperature may be 1340 to 1450° C., and the sintering time may be 30 to 180 minutes. According to this, generation of coarse tungsten carbide grain is suppressed. After that, HIP treatment may be performed under conditions of 1340 to 1450° C., 10 MPa to 200 MPa, and 0.5 to 2 hours.

<<Cooling Step>>

The cooling step is a step of cooling the cemented carbide after completion of sintering. The cooling rate is preferably 2° C./min to 10° C./min. According to this, abnormal grain growth is suppressed.

The cemented carbide of the present embodiment can be obtained by the above steps. This was newly found as a result of careful examination by the present inventors.

Embodiment 2: Mold for Ultra-High Pressure Generating Device

The mold for an ultra-high pressure generating device of the present embodiment is composed of the cemented carbide of the first embodiment. Examples of the mold for an ultra-high pressure generating device include anvils and pistons. The mold for an ultra-high pressure generating device of the present embodiment can have a long tool lifespan even under ultra-high pressure.

[Note 1] In the cemented carbide of the present disclosure, the area ratio of the first phase is preferably 86.5 area % or more and 92.5 area % or less, and the area ratio of the second phase is preferably 7.5 area % or more and 13.5 area % or less.

[Note 2] In the cemented carbide of the present disclosure, the area ratio of the first phase is preferably 88.5 area % or more and 92.5 area % or less, and the area ratio of the second phase is preferably 7.5 area % or more and 11.5 area % or less.

[Note 3] The Vickers hardness Hv30 of the cemented carbide of the present disclosure is preferably 1950 or more and 2500 or less.

[Note 4] The bending strength of the cemented carbide of the present disclosure is preferably 2.8 GPa or more and 5.0 GPa or less.

[Note 5] The cemented carbide of the present disclosure is preferably free of η phase.

[Note 6] In the cemented carbide of the present disclosure, the cobalt content of the second phase is preferably 85 mass % or more and 100 mass % or less.

EXAMPLES

The present embodiment will be described more specifically with reference to examples. However, the present embodiment is not limited by these examples.

<Production of Cemented Carbide>

Various cemented carbides different in the area ratio of the first phase and the second phase, the number of the second phases, the average grain size of the tungsten carbide grains, the Co content, the Cr content, and the V content were produced, and the alloy characteristics were measured. The cemented carbide used for the test was produced as follows.

Tungsten carbide powder (average grain size 0.1 to 0.2 μm, carbonization temperature 1400° C.) or tungsten carbide powder (average grain size 0.1 to 0.2 μm, carbonization temperature less than 1400° C.), and, cobalt (Co) powder (average grain size 0.8 μm), chromium carbide ($Cr_3C_2$) powder (average grain size 1.0 μm), and vanadium carbide (VC) powder (average grain size 0.9 μm) were prepared. For Samples 1-1 to 1-5, the tungsten carbide powder with a carbonization temperature of less than 1400° C. was used. For other samples, the tungsten carbide powder with a carbonization temperature of 1400° C. is used. These powders are mixed using a ball mill to obtain a mixed powder. The media diameter is 6 mm, the rotation speed is 60 rpm, and wet mixing is performed for 20 hours. The content of each powder in the mixed powder was adjusted so that the contents of Co, Cr, V, and WC in the sintered cemented carbide were "Co (mass %)", "Cr (mass %)", "V (mass %)", and "WC (mass %)" in Tables 1 and 2.

The mixed powder was press-molded at a pressure of 1000 kg/cm$^2$, heated to 1350° C. in vacuum, and sintered at 1350° C. for 1 hour. Thereafter, HIP treatment was performed under the conditions of 1350° C., 100 MPa, and 1 hour, and then cooled to 20° C. at a cooling rate of 10° C./min to obtain cemented carbide (width 15 mm×length 15 mm×thickness 10 mm) of each sample.

TABLE 1

| Sample No | Co (mass %) | Cr (mass %) | V (mass %) | WC (mass %) | Cr/Co (%) | V/Co (%) | First phase Area ratio (area %) | Second phase Area ratio (area %) | Second phase Number | WC Average grain size (μm) | Hardness Hv30 | Bending strength (GPa) | Lifespan |
|---|---|---|---|---|---|---|---|---|---|---|---|---|---|
| 1 | 4.5 | 0.35 | 0.15 | remainder | 8.0 | 3.0 | 91.6 | 8.4 | 1020 | 0.13 | 2100 | 3.3 | 11 |
| 2 | 5.0 | 0.32 | 0.18 | remainder | 6.0 | 4.0 | 91.2 | 8.8 | 1056 | 0.13 | 2070 | 3.5 | 15 |
| 3 | 5.5 | 0.35 | 0.21 | remainder | 6.0 | 4.0 | 90.2 | 9.8 | 1082 | 0.13 | 2070 | 4.1 | 20 |
| 4 | 6.0 | 0.40 | 0.20 | remainder | 7.0 | 3.0 | 89.4 | 10.6 | 1036 | 0.13 | 2050 | 4.2 | 21 |
| 5 | 6.3 | 0.46 | 0.19 | remainder | 7.0 | 3.0 | 89.0 | 11.0 | 1066 | 0.13 | 2050 | 4.0 | 20 |
| 6 | 6.5 | 0.40 | 0.25 | remainder | 6.0 | 4.0 | 88.7 | 11.3 | 1023 | 0.13 | 2030 | 4.3 | 20 |
| 7 | 6.7 | 0.48 | 0.24 | remainder | 7.0 | 4.0 | 88.4 | 11.6 | 1056 | 0.13 | 2000 | 4.5 | 11 |
| 8 | 7.0 | 0.50 | 0.25 | remainder | 7.0 | 4.0 | 88.0 | 12.0 | 1099 | 0.13 | 1980 | 4.3 | 10 |
| 9 | 8.0 | 0.50 | 0.30 | remainder | 6.0 | 4.0 | 87.0 | 13.0 | 1001 | 0.13 | 1950 | 4.4 | 8 |
| 10 | 8.0 | 0.40 | 0.24 | remainder | 5.0 | 3.0 | 87.0 | 13.0 | 1005 | 0.13 | 2000 | 3.8 | 9 |
| 11 | 4.5 | 0.41 | 0.15 | remainder | 9.0 | 3.0 | 91.6 | 8.4 | 1099 | 0.13 | 2110 | 3.2 | 9 |
| 12 | 5.5 | 0.38 | 0.21 | remainder | 7.0 | 4.0 | 90.2 | 9.8 | 1082 | 0.13 | 2090 | 4.2 | 22 |
| 13 | 6.0 | 0.40 | 0.12 | remainder | 7.0 | 2.0 | 89.4 | 10.6 | 1036 | 0.13 | 1978 | 4.3 | 10 |
| 14 | 5.0 | 0.32 | 0.25 | remainder | 6.0 | 5.0 | 90.9 | 9.1 | 1066 | 0.13 | 2200 | 2.8 | 6 |
| 15 | 7.0 | 0.50 | 0.25 | remainder | 7.0 | 4.0 | 88.2 | 11.8 | 1098 | 0.13 | 2011 | 4.3 | 12 |
| 16 | 4.0 | 0.36 | 0.18 | remainder | 9.0 | 4.5 | 92.3 | 7.7 | 1001 | 0.13 | 2100 | 3.1 | 10 |
| 17 | 7.0 | 0.50 | 0.25 | remainder | 7.0 | 4.0 | 88.2 | 11.8 | 1100 | 0.05 | 2100 | 4.0 | 8 |
| 18 | 7.0 | 0.50 | 0.25 | remainder | 7.0 | 4.0 | 88.2 | 11.8 | 1002 | 0.30 | 1980 | 3.5 | 7 |
| 19 | 7.0 | 0.50 | 0.25 | remainder | 7.0 | 4.0 | 88.2 | 11.8 | 1000 | 0.35 | 1980 | 3.5 | 7 |
| 20 | 6.0 | 0.54 | 0.3 | remainder | 9.0 | 5.0 | 89.4 | 10.6 | 1200 | 0.08 | 2250 | 3.1 | 4 |
| 21 | 6.0 | 0.54 | 0.24 | remainder | 9.0 | 4.0 | 89.4 | 10.6 | 1150 | 0.12 | 2160 | 3.2 | 5 |
| 22 | 4.0 | 0.36 | 0.20 | remainder | 9.0 | 5.0 | 92.5 | 7.5 | 1030 | 0.10 | 2300 | 3.2 | 4 |
| 23 | 8.0 | 0.40 | 0.16 | remainder | 5.0 | 2.0 | 86.5 | 13.5 | 1000 | 0.20 | 1980 | 4.0 | 4 |

TABLE 2

| Sample No | Co (mass %) | Cr (mass %) | V (mass %) | WC (mass %) | Cr/Co (%) | V/Co (%) | First phase Area ratio (area %) | Second phase Area ratio (area %) | Second phase Number | WC Average grain size (μm) | Hardness Hv30 | Bending strength (GPa) | Lifespan |
|---|---|---|---|---|---|---|---|---|---|---|---|---|---|
| 1-1 | 4.0 | 0.30 | 0.15 | remainder | 8.0 | 4.0 | 92.3 | 7.7 | 755 | 0.11 | 2050 | 2.4 | 1 |
| 1-2 | 5.0 | 0.35 | 0.18 | remainder | 7.0 | 4.0 | 90.9 | 9.1 | 720 | 0.08 | 1930 | 3.5 | 2 |
| 1-3 | 6.0 | 0.36 | 0.22 | remainder | 6.0 | 4.0 | 89.4 | 10.6 | 725 | 0.09 | 1930 | 3.9 | 1 |
| 1-4 | 7.0 | 0.50 | 0.20 | remainder | 7.0 | 3.0 | 88.0 | 12.0 | 801 | 0.10 | 1920 | 4.1 | 2 |
| 1-5 | 8.0 | 0.60 | 0.25 | remainder | 8.0 | 3.0 | 86.5 | 13.5 | 702 | 0.10 | 1925 | 4.3 | 2 |
| 1-6 | 4.5 | 0.18 | 0.15 | remainder | 4.0 | 3.0 | 91.6 | 8.4 | 960 | 0.13 | 1948 | 3.2 | 2 |
| 1-7 | 6.0 | 0.40 | 0.06 | remainder | 7.0 | 1.0 | 89.4 | 10.6 | 890 | 0.13 | 1808 | 4.0 | 3 |
| 1-8 | 5.0 | 0.32 | 0.30 | remainder | 6.0 | 6.0 | 90.9 | 9.1 | 1260 | 0.13 | 2100 | 2.6 | 3 |
| 2-1 | 4.0 | 0.45 | 0.22 | remainder | 11.0 | 6.0 | 92.3 | 7.7 | 1265 | 0.11 | 2065 | 2.4 | 2 |
| 2-2 | 5.0 | 0.48 | 0.24 | remainder | 10.0 | 5.0 | 90.9 | 9.1 | 1321 | 0.08 | 2000 | 2.7 | 1 |
| 2-3 | 5.7 | 0.70 | 0.30 | remainder | 12.0 | 5.0 | 89.9 | 10.1 | 1198 | 0.09 | 2050 | 2.7 | 2 |
| 2-4 | 7.0 | 0.75 | 0.48 | remainder | 11.0 | 7.0 | 88.0 | 12.0 | 1385 | 0.11 | 1940 | 3.1 | 3 |
| 2-5 | 7.4 | 0.80 | 0.45 | remainder | 11.0 | 6.0 | 87.4 | 12.6 | 1255 | 0.11 | 1940 | 3.0 | 2 |
| 2-6 | 8.0 | 0.88 | 0.33 | remainder | 11.0 | 4.0 | 86.5 | 13.5 | 1099 | 0.11 | 1925 | 4.3 | 1 |
| 2-7 | 3.8 | 0.34 | 0.19 | remainder | 9.0 | 5.0 | 93.0 | 7.0 | 899 | 0.13 | 2190 | 2.3 | 2 |
| 2-8 | 8.2 | 0.49 | 0.33 | remainder | 6.0 | 4.0 | 86.2 | 13.8 | 958 | 0.13 | 1890 | 4.2 | 2 |
| 2-9 | 4.0 | 0.15 | 0.10 | remainder | 4.0 | 3.0 | 92.3 | 7.7 | 750 | 0.15 | 1690 | 2.6 | 1 |
| 2-10 | 5.0 | 0.15 | 0.30 | remainder | 3.0 | 6.0 | 90.9 | 9.1 | 899 | 0.16 | 1780 | 3.7 | 2 |
| 2-11 | 6.0 | 0.36 | 0.10 | remainder | 6.0 | 2.0 | 89.4 | 10.6 | 856 | 0.21 | 1780 | 3.5 | 3 |
| 2-12 | 7.0 | 0.77 | 0.20 | remainder | 11.0 | 3.0 | 88.0 | 12.0 | 1260 | 0.19 | 1940 | 3.2 | 2 |
| 2-13 | 8.0 | 0.55 | 0.55 | remainder | 7.0 | 7.0 | 86.5 | 13.5 | 905 | 0.20 | 1940 | 3.0 | 2 |

<Evaluation>

<<Content of Co, Cr, and V>>

The contents of Co, Cr, and V were measured in each sample. The measurement method has already been described in Embodiment 1 and the description thereof will not be repeated. The results are shown in columns "Co (mass %)", "Cr (mass %)", and "V (mass %)" of Tables 1 and 2. Based on these values, "the mass-based percentage of chromium to cobalt (Cr/Co)" and "the mass-based percentage of vanadium to cobalt (V/Co)" were calculated. The results are shown in columns "Cr/Co (%)" and "V/Co (%)" in Tables 1 and 2. "Remainder" in the "WC (mass %)" column indicates that a value obtained by subtracting the total of the Co content, the Cr content, and the V content from 100 mass % of the entire cemented carbide is the content of WC. For example, Sample 1 has a WC content of 95.00 mass %.

<<Area Ratio of First Phase and Second Phase and Number of Second Phase>>

In each sample, the area ratio of the first phase and second phase and the number of second phases were measured. The measurement method has already been described in Embodiment 1 and the description thereof will not be repeated. The results are shown in columns of "first phase area ratio (area %)", "second phase area ratio (area %)", and "number of second phases" in Tables 1 and 2.

<<Cobalt Content of Second Phase>>

In each sample, the content of elements other than cobalt in the second phase was measured by ICP, and the value was subtracted from the entire second phase (100 mass %) to determine the cobalt content of the second phase. It was confirmed that the cobalt content of the second phase was 85 mass % or more in all the samples.

<<Vickers Hardness Hv30>>

Vickers hardness (Hv30) was measured for each sample. The measurement method has already been described in Embodiment 1 and the description thereof will not be repeated. The results are shown in "Hardness Hv30" column of Tables 1 and 2.

<<Bending Strength>>

The obtained cemented carbide was measured for bending strength. The measurement method has already been described in Embodiment 1 and the description thereof will not be repeated. The results are shown in "Bending strength (GPa)" column of Tables 1 and 2.

<<Lifespan>>

Using the cemented carbide of each sample, a multi-anvil composed of eight cubes was produced, and using the multi-anvil, graphite powder was subjected to high-temperature and high-pressure treatment under conditions of 16 GPa and 2200° C. to produce diamond. In each sample, using the same multi-anvil, the production of diamond described above was performed a plurality of times, and the number of times of production in a case where damage occurred in one or more multi-anvils was defined as the tool lifespan. For example, in a case where damage occurred in one or more multi-anvils during the fifth production of diamond, the tool lifespan is five times. The ratio of the tool lifespan of each sample when the tool lifespan of Sample 1-1 is set to 1.0 is shown in "Lifespan" column of Tables 1 and 2. For example, Sample 1 has a lifespan of "11.0". This means that the tool lifespan of Sample 1 is 11 times that of Sample 1-1.

<<Discussion>>

Sample 1 to 23 correspond to Examples. Samples 1-1 to 1-8 and Samples 2-1 to 2-13 correspond to Comparative Examples. It was confirmed that Samples 1 to 23 (Examples) had longer lifespan than Samples 1-1 to 1-8 and Samples 2-1 to 2-13 (Comparative Examples). This is presumed to be because in Samples 1 to 23 (Examples), the contents of Cr and V that suppresses the grain growth of WC grains are appropriate, and thus the structure is refined, and the third phase which may serve as the starting point of fracture is not generated, and fracture is less likely to occur.

As shown in Tables 1 and 2, in Samples 1 to 16, the number of the second phases is 1000 or more, which is larger than the number (702 to 801) of the second phases in Samples 1-1 to 1-5 corresponding to the conventional alloy, indicating that a very fine structure is obtained. In Samples 1-1 to 1-5, the carbonization temperature of the WC grains used as the raw material is less than 1400° C., so that a fine structure is not obtained and the number of the second phases is small in terms of the structure.

In Sample 1-6, Cr/Co was small, a fine structure was not obtained, and the tool lifespan was insufficient.

In Sample 1-7, V/Co was small, a fine structure was not obtained, and the tool lifespan was insufficient.

In Sample 1-8, V/Co was large and the bending strength was insufficient, so that the tool lifespan was insufficient.

In Samples 2-1 to 2-6 corresponding to the conventional alloy, Cr/Co and/or V/Co was excessive, so that a fine structure was obtained, but since Cr/Co and/or V/Co was excessive, the bending strength or hardness tended to be low, and the lifespan was shortened when used for an ultra-high pressure mold.

In Sample 2-7, the area ratio of the second phase was small and the bending strength was low, so that the tool lifespan was insufficient.

In Sample 2-8, the area ratio of the second phase was large and the hardness was insufficient, so that the tool lifespan was insufficient.

In Sample 2-9, Cr/Co was small, a fine structure was not obtained and the hardness was insufficient, so that the tool lifespan was insufficient.

In Sample 2-10, a fine structure was not obtained and the hardness was insufficient, so that the tool lifespan was insufficient.

In Sample 2-11, a fine structure was not obtained and the hardness was insufficient, so that the tool lifespan was insufficient.

In Sample 2-12, Cr/Co was large and the hardness was insufficient, so that the tool lifespan was insufficient.

In Sample 2-13, V/Co was large and the hardness was insufficient, so that the tool lifespan was insufficient.

Although the embodiments and Examples of the present disclosure have been described above, it has been planned from the beginning that the configurations of the embodiments and Examples described above may be appropriately combined or modified in various ways.

It should be understood that the embodiments and Examples disclosed herein are illustrative in all respects and are not restrictive. The scope of the present invention is defined not by the above-described embodiments and Examples but by the claims, and is intended to include meanings equivalent to the claims and all modifications within the scope.

The invention claimed is:

1. A cemented carbide comprising:

a first phase being composed of a plurality of tungsten carbide grains; and a plurality of discontinuous second phases containing cobalt, wherein:

the cemented carbide contains chromium and vanadium, a mass-based percentage of the chromium to the cobalt is 5% or more and 9% or less, a mass-based percentage of the vanadium to the cobalt is 2% or more and 5% or less, an area ratio of the plurality of discontinuous second phases is 7.5 area % or more and 13.5 area % or less, a number of the plurality of discontinuous second phases is 1000 or more, and the area ratio of the plurality of discontinuous second phases and the number of the plurality of discontinuous second phases are measured in a measurement field of 101 $\mu m^2$ by performing image processing on a scanning electron microscope image of a cross section of the cemented carbide.

2. The cemented carbide according to claim 1, wherein the area ratio of the plurality of discontinuous second phases is 7.5 area % or more and 11.5 area % or less.

3. The cemented carbide according to claim 1, wherein a cobalt content of the cemented carbide is 4 mass % or more and 8 mass % or less.

4. The cemented carbide according to claim 1, wherein the mass-based percentage of the chromium to the cobalt is 7% or more and 8% or less.

5. The cemented carbide according to claim 1, wherein the mass-based percentage of the vanadium to the cobalt is 2% or more and 4% or less.

6. The cemented carbide according to claim 1, wherein the number of the plurality of discontinuous second phases is 1000 or more and 1100 or less.

7. The cemented carbide according to claim 1, wherein the tungsten carbide grains have an average grain size of 0.05 μm or more and 0.3 μm or less.

8. The cemented carbide according to claim 1, wherein an area ratio of the first phase is 86.5 area % or more and 92.5 area % or less.

9. The cemented carbide according to claim 1, wherein the cemented carbide consists of the first phase and the plurality of discontinuous second phases.

10. The cemented carbide according to claim 1, wherein the cemented carbide is free of η phase.

11. The cemented carbide according to claim 1, wherein an area ratio of the first phase is 88.5 area % or more and 92.5 area % or less, and the area ratio of the second phase is 7.5 area % or more and 11.5 area % or less.

12. The cemented carbide according to claim 1, wherein a Vickers hardness Hv30 of the cemented carbide is 1950 or more and 2500 or less.

13. The cemented carbide according to claim 1, wherein a bending strength of the cemented carbide is 2.8 GPa or more and 5.0 GPa or less.

14. The cemented carbide according to claim 1, wherein a cobalt content of the second phase is 85 mass % or more and 100 mass % or less.

15. A mold for an ultra-high pressure generating device, being composed of the cemented carbide according to claim 1.

16. The cemented carbide according to claim 1, wherein the number of the plurality of discontinuous second phases is 1000 or more and 1200 or less.

17. The cemented carbide according to claim 1, wherein the tungsten carbide has been carbonized at a temperature of 1400° C. or more and 1600° C. or less.

18. The cemented carbide according to claim 1, wherein the area ratio of the plurality of discontinuous second phases is 7.5 area % or more and less than 10 area %.

* * * * *